US007671526B2

(12) United States Patent
Ryu

(10) Patent No.: US 7,671,526 B2
(45) Date of Patent: Mar. 2, 2010

(54) LIGHT EMISSION DEVICE AND DISPLAY DEVICE INCLUDING THE LIGHT EMISSION DEVICE

(75) Inventor: Kyung-Sun Ryu, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 399 days.

(21) Appl. No.: 11/696,672

(22) Filed: Apr. 4, 2007

(65) Prior Publication Data

US 2008/0079350 A1 Apr. 3, 2008

(30) Foreign Application Priority Data

Oct. 2, 2006 (KR) ..... 10-2006-0096937

(51) Int. Cl.
*H01J 63/04* (2006.01)

(52) U.S. Cl. ..... 313/495

(58) Field of Classification Search ..... 313/495–497; 445/24

See application file for complete search history.

(56) References Cited

U.S. PATENT DOCUMENTS

| | | | | |
|---|---|---|---|---|
| 5,489,933 | A * | 2/1996 | Betsui et al. | 347/120 |
| 5,559,390 | A * | 9/1996 | Makishima et al. | 313/308 |
| 5,760,858 | A * | 6/1998 | Hodson et al. | 349/61 |
| 2006/0145595 | A1* | 7/2006 | Youn et al. | 313/496 |
| 2007/0002004 | A1* | 1/2007 | Woo | 345/102 |

FOREIGN PATENT DOCUMENTS

| | | |
|---|---|---|
| JP | 2001-160355 | 6/2001 |
| JP | 2001-312956 | 11/2001 |
| JP | 2005-294134 | 10/2005 |

OTHER PUBLICATIONS

English Translation of JP 2001-160355 A.*
Patent Abstracts of Japan for Publication No. 2001-160355 A; dated Jun. 12, 2001 in the name of Daisuke Sasakuri.
Patent Abstracts of Japan for Publication No. 2001-312956 A; dated Nov. 9, 2001 in the name of Daisuke Sasakuri.
Patent Abstracts of Japan, Publication No. 2005-294134; Date of Publication: Oct. 20, 2005; in the name of Eisuke Negishi et al.

* cited by examiner

*Primary Examiner*—Minh-Toan Ton
*Assistant Examiner*—Hana A Sanei
(74) *Attorney, Agent, or Firm*—Christie, Parker & Hale, LLP

(57) ABSTRACT

A light emission device and display device including the light emission device are provided. The light emission device includes a first electrode located on the first substrate and extending in a first direction. A second electrode is arranged above the first electrode and extends in a second direction crossing the first direction. An insulation layer is interposed between the first and second electrodes. A plurality of electron emission regions are electrically connected to the first or second electrodes. A light emission unit is located on the second substrate. Furthermore, one or more cut-away portions are formed in the second electrode at a crossed region between the first and second electrodes such that an overlapping area between the first and second electrodes is reduced.

22 Claims, 6 Drawing Sheets

LIGHT EMISSION DEVICE AND DISPLAY DEVICE INCLUDING THE LIGHT EMISSION DEVICE

CROSS-REFERENCE TO RELATED APPLICATION

This application claims priority to and the benefit of Korean Patent Application No. 10-2006-0096937 filed on Oct. 2, 2006 in the Korean Intellectual Property Office, the entire content of which is incorporated herein by reference.

BACKGROUND OF THE INVENTION

1. Field of the Invention

The present invention relates to a light emission device that emits light using a field emission property, and a display device including the light emission device.

2. Description of the Related Art

A field emitter array (FEA) type electron emission device includes cathode and gate electrodes as driving electrodes for controlling electron emission units and emission of electrons thereof. Materials having a low work function or a high aspect ratio are used to form an electron emission unit in the FEA electron emission device. For example, carbon-based materials such as carbon nanotubes, graphite, and diamond-like carbon have been developed to be used in an electron emission unit in order for electrons to be easily emitted by an electrical field in a vacuum.

The plurality of electron emission units are arrayed on a substrate to form an electron emission device, and the electron emission device is combined with another substrate on which a phosphor layer and an anode electrode are formed to produce an electron emission display device.

SUMMARY OF THE INVENTION

In exemplary embodiments of the present invention, a light emission device with reduced capacitance between driving electrodes is provided. The reduced capacitance reduces leakage current, reduces power consumption, and prevents driving signal distortion. Furthermore, a display device utilizing the light emission device is provided. In addition, a light emission device capable of independently controlling light intensities of a plurality of divided regions of a light emission surface, and a display device capable of enhancing the dynamic contrast of an image are provided.

In an exemplary embodiment of the present invention, a light emission device is provided including a vacuum envelope having first and second substrates. A first electrode is located on the first substrate and extends in a first direction. A second electrode is located above the first electrode and extends in a second direction crossing the first direction with an insulation layer interposed between the first and second electrodes. A plurality of electron emission regions are electrically connected to the first or second electrodes. A light emission unit is located on the second substrate. One or more cut-away portions are formed in the second electrode at a crossed region between the first and second electrodes to reduce an overlapping area between the first and second electrodes.

In an exemplary embodiment of the present invention, openings may be formed in the second electrode and the insulation layer at the crossed region to partly expose the first electrode. The openings are spaced apart from the cut-away portions and the electron emission regions are located on the first electrode and exposed through the openings of the second electrode.

In an exemplary embodiment of the present invention, the openings may be arranged along a length and width of the second electrode and the cut-away portions may be arranged between the openings along the length of the second electrode.

In an exemplary embodiment of the present invention, a width of each cut-away portion, which is measured along the width of the second electrode, may be equal to a diameter of the openings, which is measured along the width of the second electrode. Each cut-away portion may have concaved opposite sides to be spaced apart from the adjacent openings.

In an exemplary embodiment of the present invention, the openings may be arranged along a length and a width of the second electrode and each cut-away portion may be located at a center of an area enclosed by an adjacent four openings. The cut-away portion may be formed in a bobbin-shape that is concaved away from the adjacent openings.

In an exemplary embodiment of the present invention, the second electrode may be formed of a material selected from the group consisting of gold, aluminum, and silver. The second electrode may have a thickness within a range of 4,000-6,000 Å. The light emission device may further include a sub-electrode located on the second electrode. The second electrode may be formed of a material selected from the group consisting of gold, aluminum, and silver.

In an exemplary embodiment of the present invention, an area of the cut-away portions at the crossed region may be 10-50% of an area of the crossed region. A gap between the first and second substrates may be within a range of 5-20 mm and the light emission unit may include a phosphor layer and an anode electrode located on the phosphor layer and receiving a high voltage within a range of 10-15 kV.

In another exemplary embodiment of the present invention, a display device is provided including a display panel assembly having a plurality of display panel assembly pixels arranged in rows and columns. A light emission device having a plurality of light emission device pixels are arranged in rows and columns for emitting light toward the display panel assembly. The number of light emission display pixels is less than the number of display panel assembly pixels. The light emission device includes a vacuum envelope having first and second substrates. A plurality of first electrodes are located on the first substrate and extend in a first direction. A plurality of second electrodes are located above the first electrodes in a second direction crossing the first direction with an insulation layer interposed between the first and second electrodes. A plurality of electron emission regions are electrically connected to the first electrodes or the second electrodes. A light emission unit is located on the second substrate. One or more cut-away portions are formed in the second electrodes at each crossed region between the first and second electrodes to reduce an overlapping area between the first and second electrodes.

In an exemplary embodiment of the present invention, openings may be formed in the second electrode and the insulation layer at the crossed region to partly expose the first electrodes and spaced apart from the cut-away portions and the electron emission regions may be formed on the exposed portions of the first electrodes through the openings of the second electrode and the insulation layer.

In an exemplary embodiment of the present invention, the openings may be arranged along a length and a width of the second electrode and the cut-away portions may be arranged between the openings along the length of the second electrode. The openings may be arranged along a length and a width of the second electrode and each cut-away portion is located at a center of an area enclosed by the adjacent four openings.

In an exemplary embodiment of the present invention, an area of the cut-away portions at the crossed region may be 10-50% of an area of the crossed region. The number of pixels arranged in each row and column of the light emission device may be in the range of 2-99.

In an exemplary embodiment of the present invention, each pixel of the light emission device emits light in response to a highest gray value among corresponding display panel assembly pixels.

DETAILED DESCRIPTION

Figure 1:
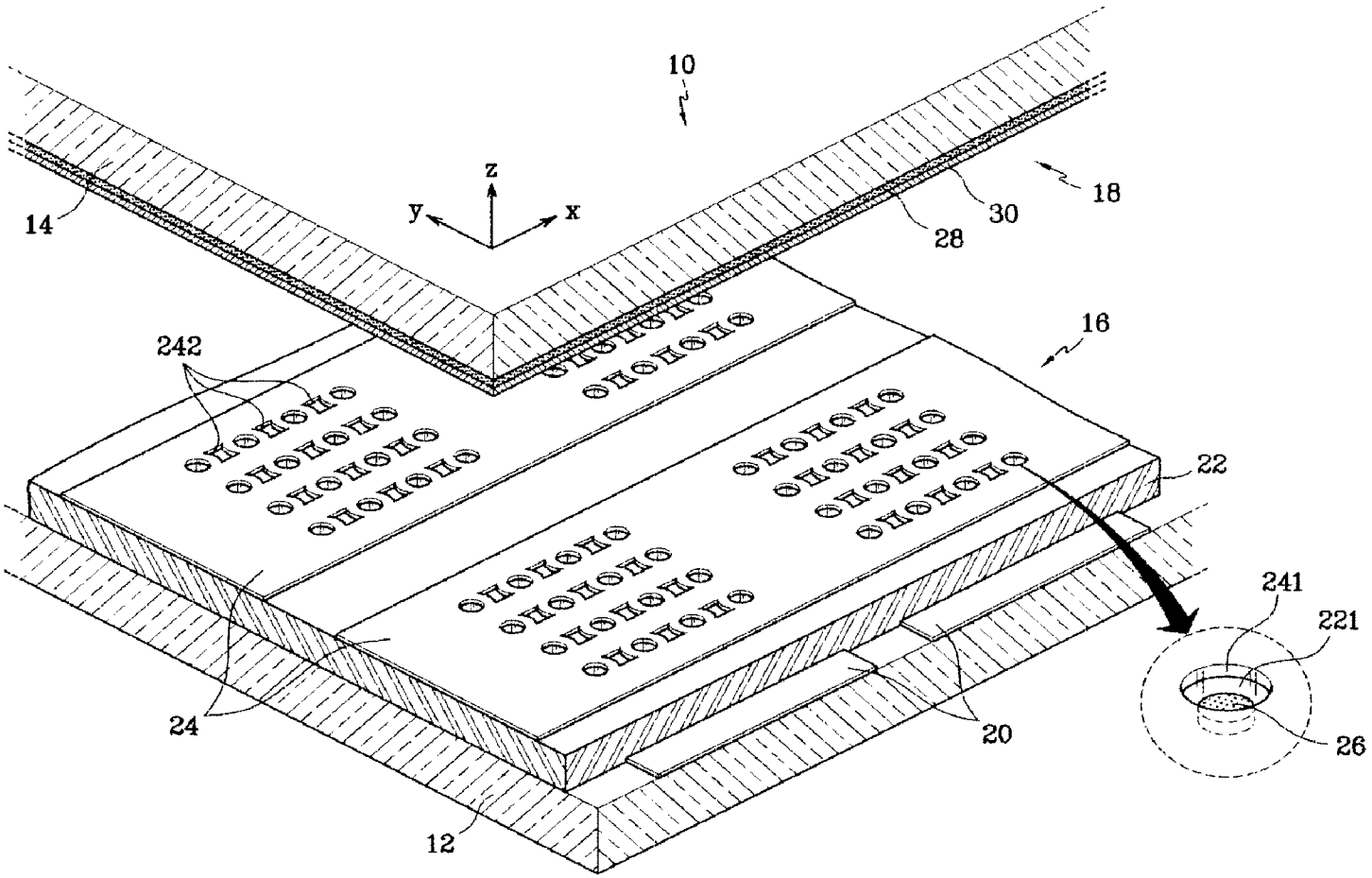
FIG. 1 is a partial exploded perspective view of a light emission device according to an exemplary embodiment of the present invention.

With reference to the accompanying drawings, embodiments of the present invention will be described in order for those skilled in the art to be able to implement it. As those skilled in the art would realize, the described embodiments may be modified in various different ways, all without departing from the spirit or scope of the present invention. Wherever possible, the same reference numbers will be used throughout the drawings to refer to the same or like parts.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms first, second, third, etc., may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," or "includes" and/or "including", when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper", "over", and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein are interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to perspective views and cross-sectional views that are schematic illustrations of idealized embodiments of the present invention. As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. As an example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

In an embodiment of the present invention, light emission device includes any device from which an emission of light can be observed. Therefore, any display device that displays symbols, letters, numbers, or images, or otherwise delivers information is also considered as a light emission device. Since the light emission device can use a self light source as well as an external light source, it also includes a device in which an external light is reflected and then emitted.

Figure 2:
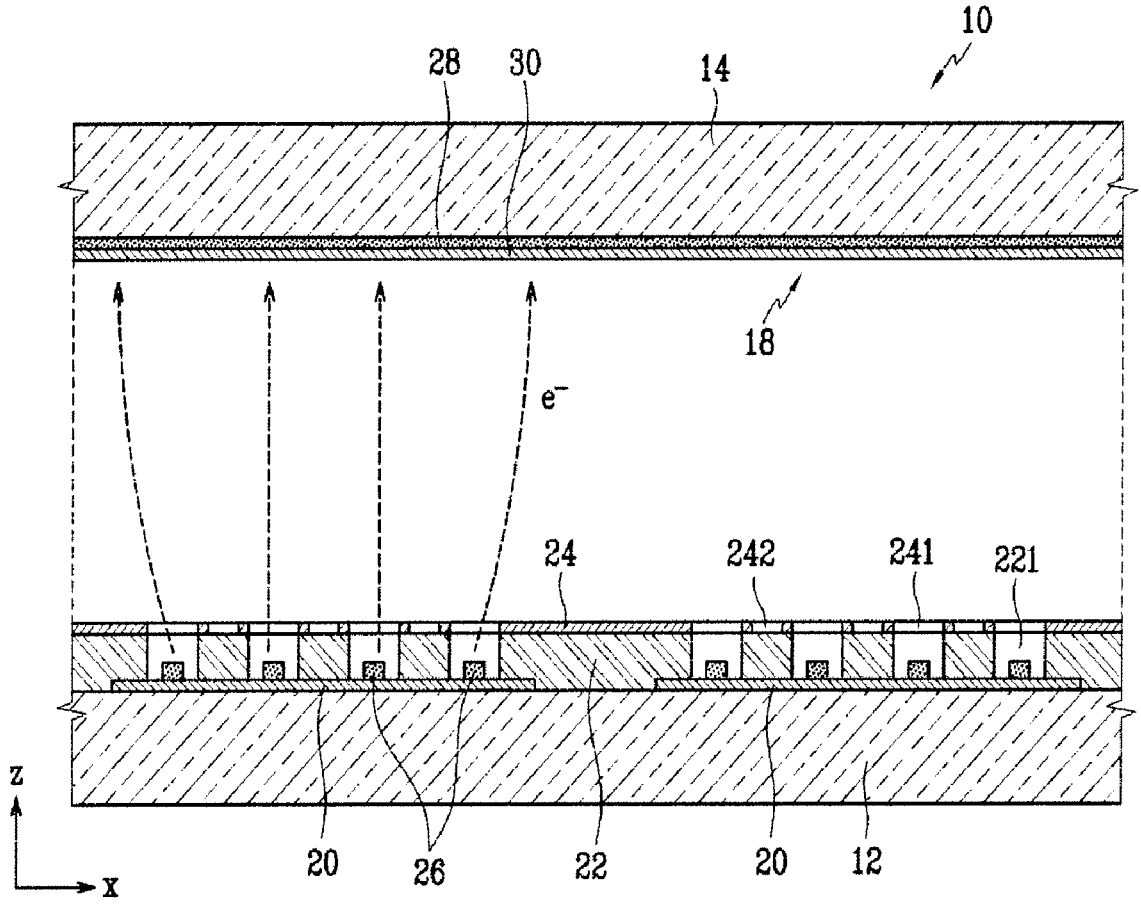
FIG. 2 is a partial sectional view of the light emission device of FIG. 1.

FIGS. 1 and 2 show a light emission device 10 according to an exemplary embodiment of the present invention.

Referring to FIGS. 1 and 2, a light emission device 10 includes first and second substrates 12 and 14 facing each other at an interval (e.g., a predetermined distance). A sealing member (not shown) is provided at or near the peripheries of the first and second substrates 12 and 14 to seal them together and thus form a sealed envelope. The interior of the sealed envelope is evacuated to a degree of vacuum of about $10^{-6}$ torr.

Each of the first and second substrates 12 and 14 has a display area for emitting visible light and an non-display area surrounding the display area within a region surrounded by the sealing member. An electron emission unit 16 for emitting electrons is provided on the first substrate 12 at the display area and a light emission unit 18 for emitting the visible light is provided on the second substrate 14 at the display area.

The electron emission unit 16 includes first electrodes 20 arranged in a stripe pattern running in a direction (i.e., the y-axis in FIG. 1) of the first substrate 12, second electrodes 24 arranged in a stripe pattern running in a direction (i.e., the x-axis in FIG. 1) crossing the first electrodes 20, an insulation layer 22 interposed between the first electrodes 20 and the second electrodes 24, and electron emission regions 26 electrically connected to the first electrodes 20 or the second electrodes 24.

When the electron emission regions 26 are formed on the first electrodes 20, the first electrodes 20 function as cathode electrodes for applying a current to the electron emission regions 26 and the second electrodes 24 function as gate electrodes for inducing the electron emission by forming the electric field around the electrode emission regions 26 according to a voltage difference between the cathode and gate electrodes. Alternatively, when the electron emission regions 26 are formed on the second electrodes 24, the second electrodes 24 function as the cathode electrodes and the first electrodes 20 function as the gate electrodes.

Openings 221 and 241 corresponding to the respective electron emission regions 26 are formed in the insulation layer 22 and the second electrodes 24 at each crossed region of the first and second electrodes 20 and 24 to partly expose the surface of the first electrodes 20. The electron emission regions 26 are formed on the exposed portions of the first electrodes 20 through the openings 221 of the insulation layer 22.

The insulation layer 22 may be formed of a material including SiC or SiN. By way of example, the insulation layer 22 may be formed to have a thickness within a range of 1 to 3 μm through a screen printing process or have a thickness less than 1 μm through a chemical vapor deposition process. The first and second electrodes 20 and 24 may be formed of a suitable metal known to those skilled in the art.

The electron emission regions 26 are formed of a material that emits electrons when an electric field is applied thereto under a vacuum atmosphere, such as a carbon-based material or a nanometer-sized material. The electron emission regions 26 can be formed of carbon nanotubes, graphite, graphite nanofibers, diamonds, diamond-like carbon, $C_{60}$, silicon nanowires or any combination thereof. The electron emission regions 26 can be formed through a screen printing process, a direct growth, a chemical vapor deposition, or a sputtering process. Alternatively, the electron emission regions can be formed in a tip structure formed of a Mo-based or Si-based material.

One crossed region of the first and second electrodes 20 and 24 may correspond to one pixel region of the light emission device 10. Alternatively, two or more crossed regions of the first and second electrodes 20 and 24 may correspond to one pixel region of the light emission device 10. In this case, two or more first electrodes 20 and/or two or more second electrodes 24 placed in one pixel region are electrically connected to each other to receive a common drive voltage.

When the light emission device 10 operates, one of the first and second electrodes 20 and 24 functions as a scan electrode for receiving a scan drive voltage and the other serves as a data electrode for receiving a data drive voltage. When predetermined drive voltages are applied to the respective first and second electrodes 20 and 24, an electric field is formed around the electron emission regions 26 at pixels where a voltage difference between the first and second electrodes 20 and 24 is higher than a threshold value and thus the electron emission regions emit the electrons.

In the above-described structure, the first and second electrodes 20 and 24 have a crossed region with the insulation layer 22 interposed therebetween. Due to the permittivity of the insulation, a parasitic capacitor having a relatively high capacitance is generated at the crossed region between the first and second electrodes 20 and 24. Since a length of a side of the crossed region is greater than 10 mm in one embodiment, the capacitance generated between the first and second electrodes 20 and 24 is relatively high. Therefore, a leakage current is generated between the driving electrodes. The generated leakage current causes the increase of the power consumption and the distortion of the driving signal.

In an exemplary embodiment, the second electrode 24 of the light emission device 10 has a structure as described below in order to reduce the capacitance generated between the first and second electrodes 20 and 24.

Figure 3:
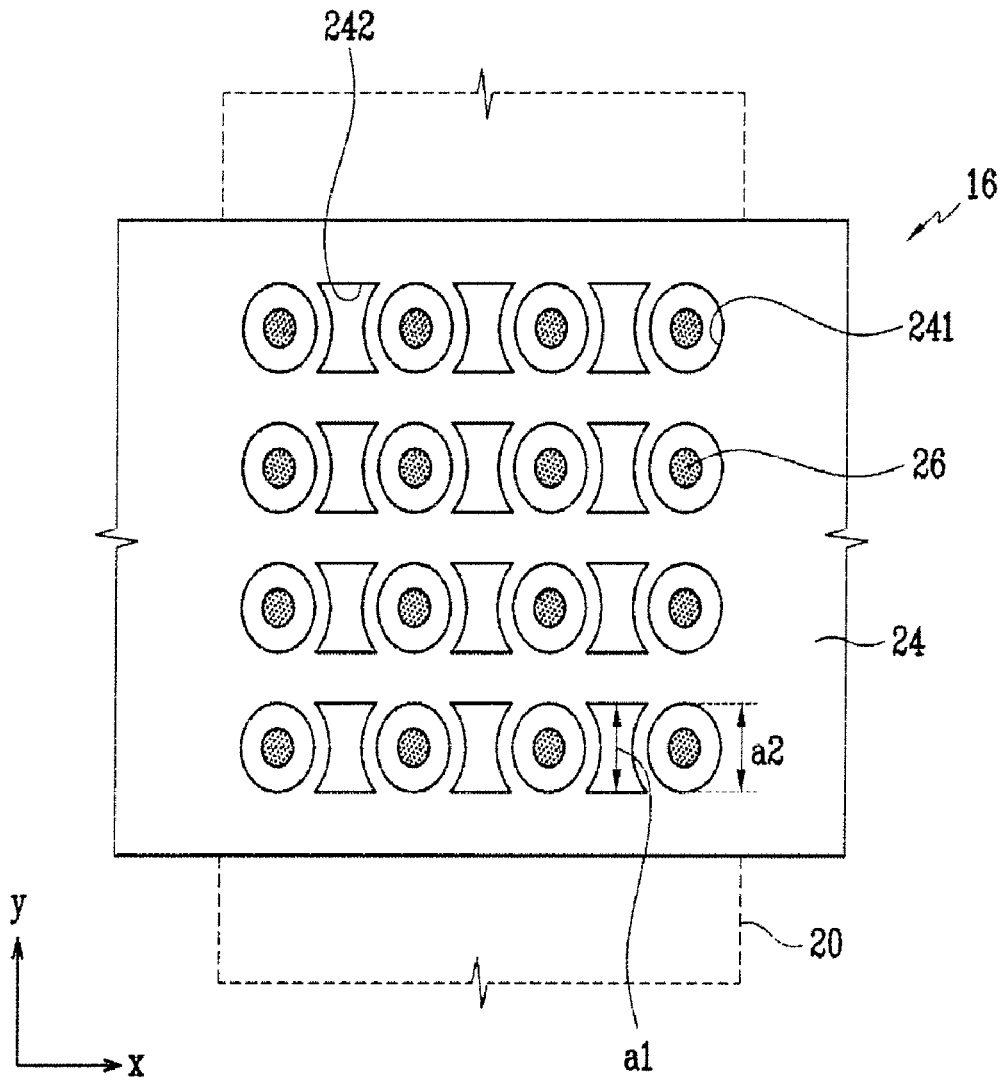
FIG. 3 is a partial top view of a light emission unit of the light emission device of FIG. 1.

FIG. 3 shows the electron emission unit 16 of the light emission device of FIG. 1.

Referring to FIGS. 1 through 3, a plurality of openings 241 and a plurality of cut-away portions 242 are formed in the second electrode at each crossed region between the first and second electrodes 20 and 24. The cut-away portions 242 are located between the openings 241. The cut-away portions 242 expose the insulation layer 22 and are formed so as to reduce the overlapping area between the first and second electrodes 20 and 24.

In the present exemplary embodiment, the cut-away portions 242 are located between the openings 241 along a length (i.e., the x-axis in FIG. 3) of the second electrode 24. A width a1 of each cut-away portion 242, which is measured along a width (i.e., the y-axis in FIG. 3) of the second electrode 24, may be equal to a diameter a2 of the opening 241, which is measured along the width of the second electrode 24. Since the cut-away portions 242 do not affect the current flow of the second electrode 24, the line resistance of the second electrode 24 is not reduced.

In addition, since the electric field is formed on the second electrode 24 around the opening 241 by the voltage difference between the first and second electrodes 20 and 24, the portion around the opening 241 must have a predetermined width. In order to maintain the width of the portion around the opening 241, there is a need to maintain a predetermined distance between the opening 241 and the cut-away portion 242. When the opening 241 is formed in a circular-shape, the cut-away portion 242 may be formed in a bobbin-shape having concave sides adjacent the openings 242 located at both sides of the cut-away portion 242.

The capacitance between the first and second electrodes 20 and 24 depends on the permittivity of the insulation layer 22, the crossed area of the first and second electrodes 20 and 24, the thickness of the insulation layer 22 and so on. In addition, the capacitance between the first and second electrodes 20 and 24 is proportional to the crossed area between the first and second electrodes 20 and 24. As the overlapping area between the first and second electrodes 20 and 24 is reduced by the cut-away portions 242, the capacitance between the first and second electrodes 20 and 24 is also lowered.

Referring again to FIGS. 1 and 2, the light emission unit 18 includes a phosphor layer 28 and an anode electrode 30 formed on the phosphor layer 28.

The phosphor layer 28 may be a white phosphor layer or a combination of red, green and blue phosphor layers. The white phosphor layer may be formed on the entire effective region of the second substrate 14 or patterned to have a plurality of sections corresponding to the respective pixel regions. The combination of the red, green and blue phosphors may correspond to one pixel region. In an exemplary embodiment, the white phosphor layer is formed on the entire display area of the second substrate 14.

The anode electrode 30 may be formed of metal such as Al and cover the phosphor layer 28. The anode electrode 30 is an acceleration electrode that receives a high voltage to maintain the phosphor layer 28 at a high electric potential state. Further, the anode electrode 30 enhances the luminance by reflecting the visible light emitted from the phosphor layer 28 toward the second substrate 14.

Spacers (not shown) for uniformly maintaining a gap between the first and second substrates 12 and 14 against the outer force are located between the first and second substrates 12 and 14.

The above-described light emission device 10 is driven by applying drive voltages to the first and second electrodes 20 and 24 and applying thousands of volts of a positive DC voltage to the anode electrode 30. Then, an electric field is formed around the electron emission regions 26 at pixel regions where a voltage difference between the first and second electrodes 20 and 24 is higher than a threshold value, thereby emitting electrons from the electron emission regions 26. The emitted electrons are accelerated by the high voltage applied to the anode electrode 30 to collide with the corresponding phosphor layer 28, thereby exciting the phosphor layer 28. A light emission intensity of the phosphor layer 28 at each pixel is proportional to an electron emission amount of the corresponding pixel.

During the above-described driving process, as the capacitance between the first and second electrodes 20 and 24 is lowered by the above-described structure of the second electrode 24, the leakage current between the first and second electrodes 20 and 24 is reduced, thereby reducing the power consumption.

Furthermore, the scan drive voltage and the data drive voltage are applied in the form of pulse. The time constant for determining the distortion of the pulse signal is proportional to the electrode resistance and the capacitance. Therefore, in an exemplary embodiment, as the capacitance is lowered, the signal distortion is suppressed and the electron emission amount of each pixel can be precisely controlled.

Figure 4:
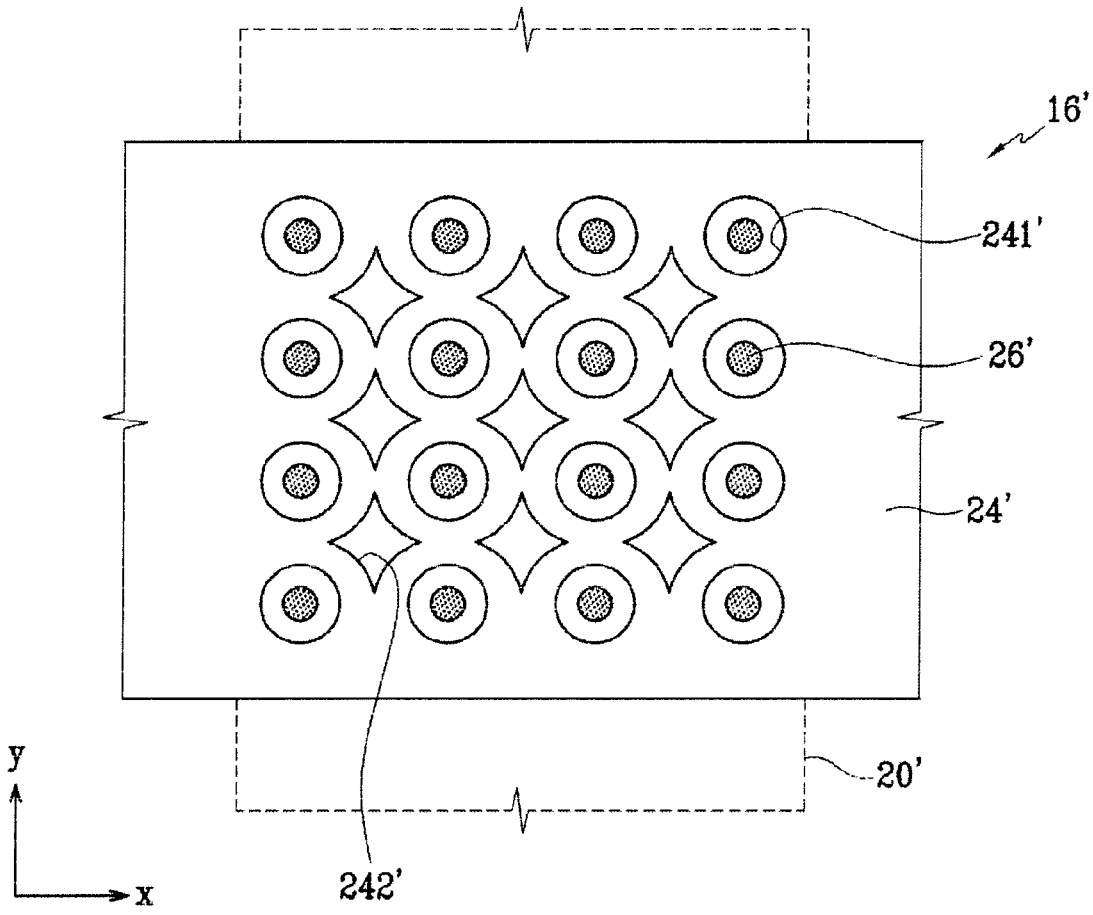
FIG. 4 is a partial top view of a light emission unit of a light emission device according to another exemplary embodiment of the present invention.

FIG. 4 shows an electron emission unit of a light emission device according to another exemplary embodiment of the present invention.

Referring to FIG. 4, a cut-away portion 242' is formed in a center of each tetragonal region defined by a closed line interconnecting centers of four adjacent openings arranged in a length and width of the second electrode 24'. In another exemplary embodiment, a center of each cut-away portion 242' is offset with respect to the centers of the adjacent openings 241' in the length and width of the second electrode 24'. Edge sides of the cut-away portion 242' are spaced apart from the respective adjacent openings 241' by a distance (e.g., a predetermined distance).

According to another exemplary embodiment, an area of each cut-away portion 242' is enlarged and thus the overlapping area between the first and second electrodes 20' and 24' can be further reduced compared with the foregoing exemplary embodiment of FIG. 3. However, since the enlarged cut-away portions 242' may deteriorate the current flow along the second electrode 24', the resistance of the second electrode 24' may increase.

Figure 5:
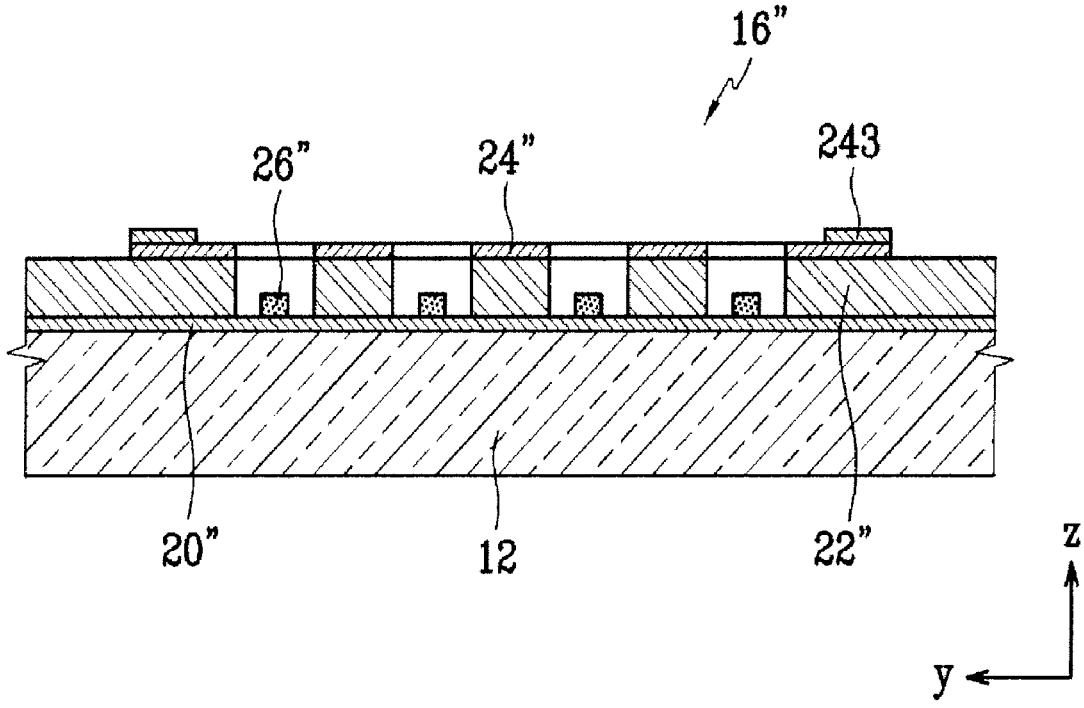
FIG. 5 is a partial sectional view of a light emission unit of a light emission device according to still another exemplary embodiment of the present invention.

Therefore, in another exemplary embodiment, the second electrode 24' may be formed of a low resistive metal material including silver, aluminum, or gold, while having a thickness within a range of abut 4,000-6,000 Å. Alternatively, as shown in FIG. 5, a sub-electrode 243 formed of the low resistive material may be formed on a second electrode 24" along the length of the second electrode 24".

In the above exemplary embodiments, the cut-away portions 242, 242' at each crossed region of the first and second electrodes 10 and 24, 24' may be formed to be 10-50% of the area of the crossed region of the first and second electrodes 10 and 24, 24'. When the cut-away portions 242, 242' are formed to be less than 10% of the area of the crossed region, it is difficult to sufficiently reduce the capacitance. When the cut-away portions 242, 242' are formed to be higher than 50%, the resistance of the second electrode 24, 24' increases. The increase of the resistance of the second electrode 24, 24' causes a voltage drop and thus non-uniform luminance.

In another exemplary embodiment, the gap between the first and second substrates 12 and 14 may be in the range of, for example, 5-20 mm that is greater than that of a typical field emission type light emission device. The anode electrode 30 receives a high voltage above 10 kV, and in an exemplary embodiment, of about 10-15 kV. Accordingly, the inventive light emission device 10 realizes a luminance above 10,000 cd/m$^2$ at a central portion of the effective region.

Figure 6:
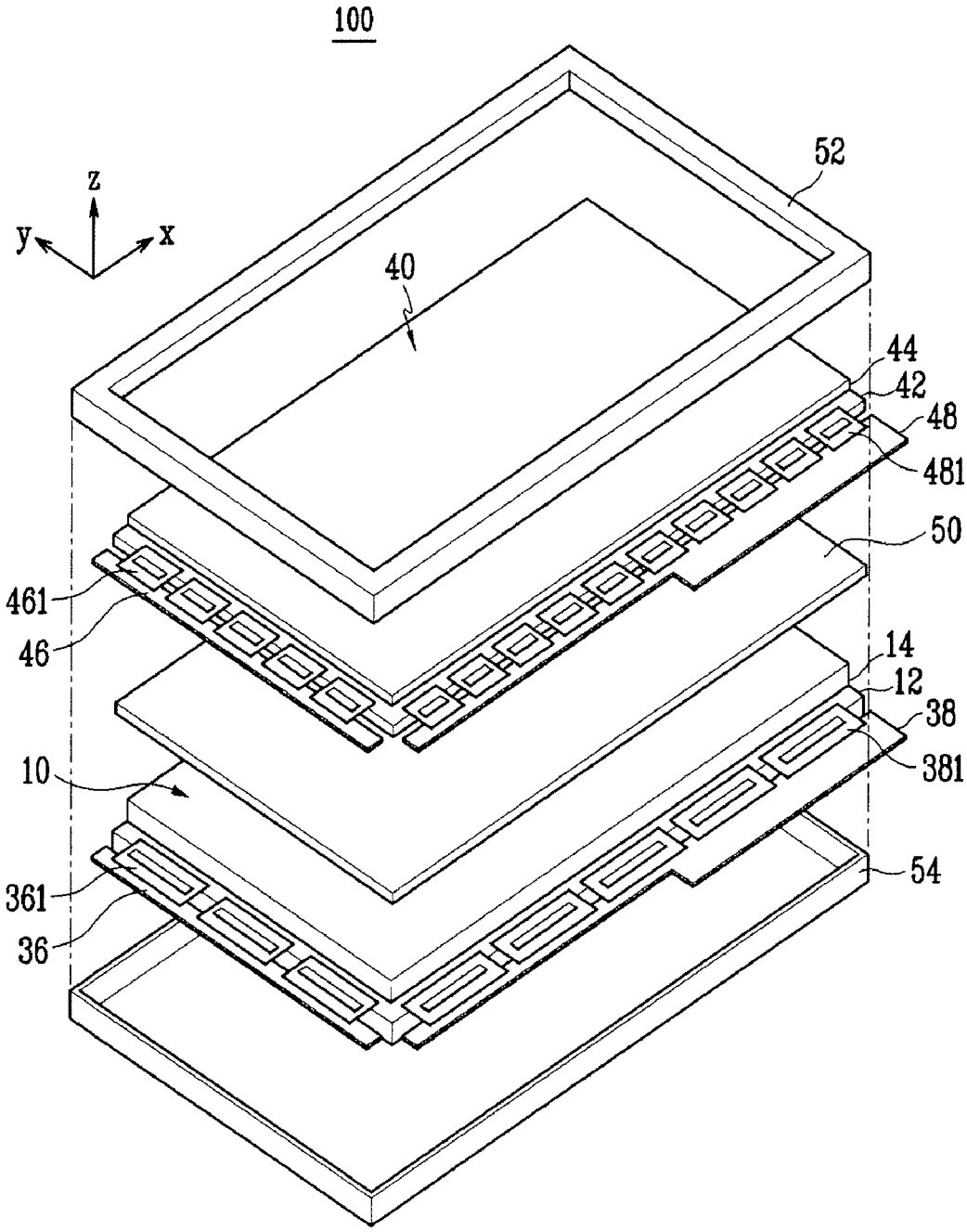
FIG. 6 is a partial exploded perspective view of a liquid crystal display according to an exemplary embodiment of the present invention.

FIG. 6 is an exploded perspective view of a display device 100 provided with a light emission device 10 according to an exemplary embodiment of the present invention.

The conventional light emission devices are required to maintain a predetermined brightness when the liquid crystal display is driven. However, it is difficult to improve the display quality of the liquid crystal display to a sufficient level. For example, when the liquid crystal panel assembly displays an image having a high luminance portion and a low luminance portion in response to an image signal, it will be possible to realize an image having a more improved dynamic contrast if the light emission device can emit lights having different intensities to the respective high and low luminance portions. However, since the conventional light emission devices cannot achieve the above function, improving the dynamic contrast of an image in a conventional liquid crystal display is limited.

On the contrary, according to an exemplary embodiment of the present invention, the above problems are easily solved by using the above light emission device that can realize a dimming driving.

Referring to FIG. 6, the display device 100 includes the light emission device 10 and a display panel assembly 40 located in front of the light emission device 10. A diffusing plate 50 may be located between the light emission device 10 and the display panel assembly 40. The diffusing plate 50 uniformly diffuses light emitted from the light emission device 10 and supplies it to the display panel assembly 40. The diffusing plate 50 and the light emission device 10 are spaced apart from each other at a predetermined distance. A top chassis 52 is located in front of the display panel assembly 40 while a bottom chassis 54 is located in the rear of the light emission device 10.

The display panel assembly 40 may be liquid crystal display or other non-self emissive display panel. A case where the display panel assembly 40 is a liquid crystal display as an example will be explained below.

The display panel assembly 40 includes a thin film transistor (TFT) panel 42 including of a plurality of TFTs, a color filter panel 44 that is positioned over the TFT panel 42, and a liquid crystal (not shown) injected between these panels. Polarizers (not shown) are attached to an upper portion of the color filter panel 44 and a lower portion of the TFT panel 42 such that light passing through the display panel assembly 40 is polarized.

The TFT panel 42 is a transparent glass panel on which thin film transistors having a matrix shape are formed. A data line is connected to a source terminal of the TFT panel 42, and a gate line is connected to a gate terminal thereof. A pixel electrode including of transparent indium tin oxide (ITO) as a conductive material is formed in a drain terminal.

If an electrical signal is input from the first printed circuit boards 46 and 48 to the gate and data lines, respectively, the electrical signal is input to the source terminal and the gate terminal of the TFT, and the TFT is turned on or off by the input of the electrical signal. Therefore, an electrical signal required for forming a pixel is output to the drain terminal.

A color filter panel 44 is a panel in which RGB pixels, which are color pixels for displaying a predetermined color when light passes, are formed by a thin film forming process. A common electrode made of ITO is coated on the whole surface of the color filter panel 44.

An electric field is formed between the pixel electrode and the common electrode of the color filter panel when power is applied to the gate terminal and the source terminal of the TFT and the thin film transistor turns on. An array angle of liquid crystal injected between the TFT panel 42 and the color filter panel 44 is changed by the electric field and light transmission changes depending on the changed array angle, whereby a desired pixel is obtained.

The first printed circuit boards 46 and 48 of the display panel assembly 40 contact the driving integrated circuit (IC) packages 461 and 481, respectively. The gate printed circuit board 46 transmits a gate driving signal while the data printed circuit board 48 transmits a data driving signal to drive the display panel assembly 40.

In an exemplary embodiment, the number of pixels of the light emission device 10 is less than that of the display panel assembly 40 so that one pixel of the light emission device 10 corresponds to two or more pixels of the display panel assembly 40. Each pixel of the light emission device 10 emits light in response to the highest gray value among the corresponding pixels of the display panel assembly 40. The light emission device 10 can represent 2-8 bits gray value at each pixel.

For convenience, the pixels of the display panel assembly 40 will be referred to as first pixels and the pixels of the light emission device 10 will be referred to as second pixels. In addition, a plurality of first pixels corresponding to one second pixel will be referred to as a first pixel group.

In order to drive the light emission device 10, a signal control unit (not shown) for controlling the display panel assembly 40 detects a highest gray value among the first pixels of the first pixel group, calculates a gray value required for the light emission of the second pixel according to the detected gray value, converts the calculated gray value into digital data, and generates a driving signal of the light emission device 10 using the digital data. The driving signals of the light emission device 10 include scanning driving signals and data driving signals.

The second printed circuit boards 36 and 38 of the light emission device 10 contacts driving IC packages 361 and 381, respectively. The scanning printed circuit board 36 transmits a scanning driving signal while the data printed circuit board 38 transmits a data driving signal to drive the light emission device 10. The scanning driving signal is applied to an electrode among the first and second electrodes 22 and 28 while the data driving signal is applied to the other electrode.

When an image is displayed by the first pixel group, the corresponding second pixel of the light emission device 10 is synchronized with the first pixel group to emit the light with a predetermined gray value. The number of pixels arranged in each row and column of the light emission device 10 may be 2-99. When the number of the pixels in each row and column of the light emission device 10 is greater than 99, it is complicated to drive the backlight and the cost for manufacturing the driving circuit increases.

As described above, the light emission intensities of the pixels of the light emission device 10 are independently controlled to emit a proper intensity of the light corresponding to each second pixel group of the display panel assembly 40. As a result, the display device 100 of an exemplary embodiment can enhance the dynamic contrast of the screen, thereby improving the display quality.

Although exemplary embodiments of the present invention have been shown and described, it will be appreciated by those skilled in the art that changes may be made in the exemplary embodiments without departing from the principles and spirit of the invention, the scope of which is defined in the claims and their equivalents.

What is claimed is:

1. A light emission device comprising:

a vacuum envelope having a first substrate and a second substrate;

a first electrode located on the first substrate and extending in a first direction;

a second electrode located over the first electrode and extending in a second direction crossing the first direction at a crossing region with an insulation layer interposed between the first electrode and the second electrode;

a plurality of electron emission regions electrically connected to the first electrode or the second electrode; and a light emission unit located on the second substrate, wherein at least one cut-away portion, each having at least two curved sides that bow inwardly toward each other, is in the second electrode at the crossing region between the first electrode and the second electrode such that an overlapping area between the first electrode and the second electrode is reduced.

2. The light emission device of claim 1, wherein openings are formed in the second electrode and the insulation layer at the crossing region to partly expose the first electrode, the openings being spaced apart from said at least one cut-away portion; and the electron emission regions are located on the first electrode and exposed through the openings of the second electrode.

3. The light emission device of claim 2, wherein the openings are arranged along a length and a width of the second electrode; and said at least one cut-away portion is arranged between the openings along the length of the second electrode.

4. The light emission device of claim 3, wherein a width of each said at least one cut-away portion, which is measured along the width of the second electrode, is equal to a diameter of the openings, which is measured along the width of the second electrode; and each said at least one cut-away portion has concave opposite sides spaced apart from adjacent openings.

5. The light emission device of claim 2, wherein the openings are arranged along a length and a width of the second electrode; and each said at least one cut-away portion is located at a center of an area surrounded by four adjacent said openings of the second electrode.

6. The light emission device of claim 5, wherein said at least one cut-away portion is formed in a bobbin-shape that is concaved away from adjacent openings.

7. The light emission device of claim 5, wherein the second electrode comprises a material selected from the group consisting of gold, aluminum, and silver.

8. The light emission device of claim 5, wherein the second electrode has a thickness within a range of 4,000-6,000 Å.

9. The light emission device of claim 5, further comprising a sub-electrode located on the second electrode, wherein the second electrode comprises a material selected from the group consisting of gold, aluminum, and silver.

10. The light emission device of claim 1, wherein an area of said at least one cut-away portion at the crossing region is 10-50% of an area of the crossing region.

11. The light emission device of claim 1, wherein a gap between the first substrate and the second substrate is within a range of 5-20 mm; and the light emission unit includes a phosphor layer and an anode electrode located on the phosphor layer, wherein the anode electrode receives a voltage within a range of 10-15 kV.

12. The light emission device of claim 1, wherein each of the at least one cut-away portions further has two parallel sides.

13. The light emission device of claim 1, wherein the at least two curved sides comprise two pairs of curved sides, the curved sides of each pair bowing inwardly towards each other.

14. A display device comprising:

a display panel assembly having a plurality of first pixels arranged in rows and columns; and a light emission device having a plurality of second pixels arranged in rows and columns for emitting light toward the display panel assembly, a number of second pixels being less than a number of first pixels, wherein, the light emission device comprises:

a vacuum envelope having a first substrate and a second substrate;

a plurality of first electrodes located on the first substrate and extending in a first direction;

a plurality of second electrodes located over the first electrodes and extending in a second direction crossing the first direction in crossing regions with an insulation layer interposed between the first electrodes and the second electrodes;

a plurality of electron emission regions electrically connected to the first electrodes or the second electrodes; and a light emission unit located on the second substrate, wherein at least one cut-away portion, each having at least two curved sides that bow inwardly toward each other, is in the second electrodes at the crossing regions between the first electrodes and the second electrodes such that an overlapping area between the first electrodes and the second electrodes is reduced.

15. The display device of claim 14, wherein openings are formed in the second electrodes and the insulation layer at the crossing regions to partly expose the first electrodes, the openings being spaced apart from said at least one cut-away portion; and the electron emission regions are located on exposed portions of the first electrodes through the openings of the second electrodes and the insulation layer.

16. The display device of claim 15, wherein the openings are arranged along a length and a width of the second electrodes; and said at least one cut-away portion is arranged between the openings along the length of the second electrodes.

17. The display device of claim 15, wherein the openings are arranged along a length and a width of the second electrode; and each said at least one cut-away portion is located at a center of an area surrounded by four adjacent said openings of the second electrode.

18. The display device of claim 14, wherein an area of said at least one cut-away portion at the crossing regions is 10%-50% of an area of the crossing regions.

19. The display device of claim 14, wherein the number of second pixels arranged in each row and column is greater than or equal to 2 and less than or equal to 99.

20. The display device of claim 19, wherein each of the second pixels emits light in response to a highest gray value among corresponding said first pixels.

21. A method of reducing electrode capacitance in a light emission device having a first electrode extending in a first direction, a second electrode extending in a second direction crossing the first direction, and a plurality of electron emission openings formed in the second electrode in a crossing region of the first electrode and the second electrode, the electrode capacitance being a capacitance between the first electrode and the second electrode, the method comprising:

forming a plurality of cut-away portions, each having at least two curved sides that bow inwardly toward each other, in the second electrode adjacent the plurality of electron emission openings in said crossing region.

22. The method as claimed in claim 21, the method further comprising:

forming the plurality of cut-away portions such that an area of the plurality of cut-away portions is in the range of 10%-50% of an area of said crossing region.

* * * * *